US009303943B2

(12) United States Patent
Breslin

(10) Patent No.: US 9,303,943 B2
(45) Date of Patent: Apr. 5, 2016

(54) STRINGED PROJECTILE WEAPON

(71) Applicant: Michael Breslin, St. Louis, MO (US)

(72) Inventor: Michael Breslin, St. Louis, MO (US)

(73) Assignee: Michael Breslin, St. Louis, MO (US)

( * ) Notice: Subject to any disclaimer, the term of this patent is extended or adjusted under 35 U.S.C. 154(b) by 0 days.

(21) Appl. No.: 14/221,055

(22) Filed: Mar. 20, 2014

(65) Prior Publication Data

US 2014/0283802 A1 Sep. 25, 2014

Related U.S. Application Data

(60) Provisional application No. 61/852,669, filed on Mar. 20, 2013.

(51) Int. Cl.
*F41B 7/00* (2006.01)
*F41B 5/00* (2006.01)

(52) U.S. Cl.
CPC ..... *F41B 5/0094* (2013.01); *F41B 7/00* (2013.01)

(58) Field of Classification Search
CPC ..... F41B 3/02; F41B 5/00; F41B 5/10; F41B 7/00; F41B 7/04
See application file for complete search history.

(56) References Cited

U.S. PATENT DOCUMENTS

| | | | | |
|---|---|---|---|---|
| 4,848,306 | A | 7/1989 | Treaster | |
| 4,903,677 | A | 2/1990 | Colley et al. | |
| 6,698,413 | B1 | 3/2004 | Ecklund | |
| 8,136,514 | B2 * | 3/2012 | Howard et al. | 124/23.1 |
| 2010/0229845 | A1 | 9/2010 | Woods, Jr. | |
| 2012/0222663 | A1 | 9/2012 | Nebergall | |

OTHER PUBLICATIONS

International Search Report, International Application No. PCT/US2014/031357, issued on Sep. 9, 2014, 12 pages.
Hancock, Rulon I., United States National Archery Association, Flight Committee, Primitive Bow Flight Rules, N.A.A. Primitive Bow Rules, Feb. 2004, 5 pages.

* cited by examiner

*Primary Examiner* — John Ricci
(74) *Attorney, Agent, or Firm* — Lewis Rice LLC

(57) ABSTRACT

A stringed weapon for launching shafted projectiles while eliminating a flat spring construction. Specifically, the stringed weapon herein utilizes a torsional spring, and particularly a torsional coil spring, to provide for the force to move the string and, thus, fire the projectile.

4 Claims, 6 Drawing Sheets

STRINGED PROJECTILE WEAPON

CROSS REFERENCE TO RELATED APPLICATIONS

This application claims the benefit of U.S. Provisional Patent Application No. 61/852,669, filed Mar. 20, 2013, the entire disclosure of which is herein incorporated by reference.

BACKGROUND OF THE INVENTION

1. Field of the Invention

This disclosure generally relates to stringed weapons used for propelling a shafted projectile such as an arrow or bolt.

2. Description of the Related Art

The bow and arrow is a weapon of ancient providence and a relatively simple structure that has not dramatically changed in thousands of years. Conventional and historical bows use a bendable structure connected via a string that has an ability to store the potential energy of a deformation of its longitudinal shape and transfer that to a projectile via a string. The deformation is accomplished by the force of the user's draw on a string attached to two or more support points of the structure of the bow. The bow acts as a flat spring storing the kinetic energy of the draw. The string and bow shape can provide for some mechanical advantage, allowing the structure of the bow to be bent more easily as the force is generally applied at an angle to the bend.

The more the bow is bent, the more stored potential energy is available. However, in traditional bows, the amount of force needed to incrementally increase the draw distance increases as the bow is drawn. Thus, a traditional bow gains much of its power from the last few inches of its deformation. Once the bow has been sufficiently deformed (drawn), a projectile which was previously placed on the string (nocked) is aimed. The string is then suddenly released by the user. The release of the string allows the bow to quickly return toward its non-deformed position converting the potential energy of the flat spring of the bow into kinetic energy in the movement of the string and associated projectile. Once the bow has reached its original (pre-drawn) position or equilibrium point, the string will generally stop suddenly allowing the projectile to leave the string while maintaining its momentum and be fired by the bow.

While there are a number of different variations of this basic system, they all generally utilize the same method of projectile delivery and a huge number of different stringed weapons all utilize this same basic principle of operation. Bows, crossbows, stone-bows, ballistae, and arbalests all utilize the returning force from the deformation of a flat spring to accelerate the string and the associated projectile. In all of them, a flat spring (such as a bent piece of wood or plastic) serves to form the structure of the "bow" and the spring is increasingly bent as the bow is drawn. Generally, the only difference between these stringed weapons are their size, the method of release of the string (such as by a trigger or by hand), the type of projectile that they fire (such as an arrow or bolt), and the method that is used to draw them (whether by hand or utilizing a machine such as a pulley).

While the general concept of the bow as a stringed weapon has not changed for centuries, there have been a number of modern improvements. The most traditional designs of a bow (often referred to as simple or composite bows based on the materials of their construction) generally use a flat or slightly curved piece of material to be the spring. Some other designs, such as recurve, reflex, decurve, and deflex bows all generally utilize the same basic construction, but alter the shape of the spring and utilize curves of a variety of different shapes to improve ease of draw and provide various other benefits. Further, some of these utilize a single flat spring applying load to both ends simultaneously, while others utilize two springs mounted to a more rigid center grip where each flat spring is simultaneously loaded in a cantilever fashion.

A modern compound bow is probably the most technically complex form of bow. A compound bow utilizes a series of pulleys as part of its structure to generally assist in drawing the string and bending the flat springs. This allows for a much more powerful bow to be drawn (and held drawn) more easily. However, even a compound bow generally still utilizes flat springs to ultimately provide the projectile with energy. The springs, however, are generally much more rigid, are often held at specific angles relative to the user and commonly only take up a portion of the bow with most of the bow structure being given over to grips and stabilizing components. This more compact design combined with higher draw strength has made compact bows a common choice for hunters.

The energy storage method of the bow places limitations on the size and weight of the system. As each end of the string is attached to a separate support (specifically, to each end of the bow), the spring is generally bent about the middle where the hand is placed. Thus, more powerful bows often have to utilize a much longer body to make it possible for a user to be able to draw the bow by hand.

On a compound bow, and some more modern bows, the bow actually comprises a pair of cantilever springs each of which is affixed on either side of the handle where the user grips the bow. The string is then connected between them. The use of multiple flat springs (or even a single spring where the exact center is not known) can result in a release of force with a variation between each discrete structure and, thus, these bows have to be carefully balanced and manufactured to produce an accurate firing profile.

While these bow styles are all generally adequate for projecting an arrow in a controlled or competitive environment, use in the wild can generally put a limit on the effectiveness of a bow. Heavy brush can compromise the trajectory and space needed to both accommodate a bow of sufficient draw strength to bring down a large animal and to perform the draw and release cycles of the shooter. Bows are generally quite large devices because of the use of the structure to act as the leaf spring and for the mass of the structure itself to absorb some of the energy of firing. Further, the bows generally need to be held either horizontally or vertically to provide for accurate aiming and to inhibit the bow's retraction from pulling the aim off.

Because of their size, bows (particularly more powerful versions) are not readily transportable. As such, they are often not useable in scenarios where they otherwise may be. For example, a bow is generally much quieter than a firearm making it useful in certain military and hunting tasks. Further, a bow is not a common survival preparation weapon as while it can use much more readily available ammunition, it can be difficult to store and transport compactly.

Additionally, the complexity of modern compound bows inhibits the ability of the user to adjust the draw weight of the string in the field. Generally for a more standard bow, the only adjustment that can be made to firing strength is to "partially draw" the bow, but this is an inexact science and can also readily serve to spoil the aiming. While a compound bow can generally be provided with different draw strengths by altering the specific rotation of the pulleys (which are often asymmetric), special equipment is often needed to perform this task and it often has to be done with the string removed. Thus, changing the draw strength in the field is next to impossible.

Another problem with bows is the inherent danger from structural failure inherent, particularly in compound bows, when the weapon undergoes a dry fire or dry loosing. This occurs when the weapon is fired without a projectile and while archers will avoid doing it, arrows will occasionally become unnocked during the draw, or the target can move making a shot impossible and slowly releasing the draw can be difficult. Dry firing or loosing can be extremely dangerous with a stringed weapon as the projectile of a stringed weapon is generally designed to absorb a large amount of the released energy of the weapon. Without a projectile to absorb the energy, the energy can be dissipated into the structure of the bow and/or string, potentially destroying it structurally and often in an explosive fashion.

SUMMARY

Because of these and other problems in the art, a need exists for a weapon that allows for a projectile, particularly a shafted projectile such as, but not limited to, an arrow or bolt, to be fired without having to utilize the inherent weaknesses of a traditional bow. In particular, there is a need for a stringed weapon which is more compact, consistent, and adjustable which can utilize an arrow or similar projectile. Such a device should provide a user with a higher level of accuracy, safety, and adaptability to a variety of circumstances than traditional stringed weapons.

Described herein are methods and systems for a stringed weapon designed to project arrows or similar projectiles in a hunting, animal control, competitive sport, or military setting. Particularly, the bow described herein allows for the projection of arrows without the historical methodology of flat spring construction. The bow discussed herein utilizes a torsional spring, and particularly a torsional coil spring, to provide for the force to move the string and, thus, fire the projectile. The bow can provide delivery of identical forces on each of the ends of the string and can readily allow the adjustment of draw weight in the field.

There is described herein, among other things, a stringed weapon comprising: a body structure; a string having two ends and a nock point along a length therebetween; a torsional spring located within the body structure; and a string spool located within the body structure; wherein, both ends of the string are connected to the string spool and the string spool is functionally connected to the torsional spring so that drawing the nock point in a first direction serves to unwind the string from the spool in a first direction, the rotation of the spool in the first direction applying force to the spring so as to increase the potential energy of the spring; and wherein release of the string allows the spring to release the potential energy by rotating the spool in a second direction opposite the first, the release of potential energy rewinding the string on the spool and firing a projectile located at the nock point from the weapon.

In an embodiment of the weapon, the string enters the housing at two portals, the portals being placed generally equidistant from the nock point at substantially all positions of the nock point through the drawing and the firing.

In an embodiment of the weapon, the housing includes a grip contoured to fit a human hand.

In an embodiment of the weapon, the torsional spring is a coil spring.

In an embodiment of the weapon, the spool includes sections of at least two different circumferences.

In an embodiment of the weapon, a larger circumference section of the spool is used to draw the string toward the end of the draw path and a smaller circumference section of the spool is used to draw the string toward the beginning of the draw path.

In an embodiment of the weapon, a larger circumference section of the spool is used to retract the string and a smaller circumference section of the spool is used to draw the string.

In an embodiment, the weapon further comprises an adjustable axis which allows for modification of the torsion applied to the spring without drawing the string.

In an embodiment, the weapon further comprises a second spring operatively connected to the spool.

In an embodiment of the weapon, the projectile is a shafted projectile.

In an embodiment of the weapon, the shafted projectile is an arrow.

In an embodiment of the weapon, the shafted projectile is a bolt.

DETAILED DESCRIPTION OF THE PREFERRED EMBODIMENT(S)

Described herein are methods and the systems for a stringed weapon capable of firing a projectile which utilizes a torsion spring, and specifically a torsion coil spring, to provide for a majority of the force to the resultant projectile.

This disclosure will generally refer to the device as a "bow". However, as would be understood by one of ordinary skill in the art, traditional bows utilize one or more flat springs to provide for force to the string and, thus, the projectile. The flat spring(s) generally form the arms of the bow and the arms flex as the string is drawn. The present device will generally not flex in any significant fashion and will instead utilize an internal torsion spring to coil the string during firing. The term "bow" is used herein as a general term for a stringed weapon which utilizes a taut string to transfer force to the projectile.

Further, the projectile fired by the bow discussed herein will generally be referred to as an "arrow". It should be recognized, however, that there is no need for the bow herein to fire an arrow. In an alternative embodiment, the bow can fire a bolt or quarrel or can fire a solid projectile such as a stone or bullet. The term "arrow" as used herein is used primarily for simplicity as modification of the bow in order to fire a projectile other than an arrow will be immediately apparent to one of ordinary skill in the art. Further, the term "arrow" is used herein because the projectile is generally preferred to be a shafted projectile as opposed to a bullet or ball. This is preferred as bullets and similar projectiles are far more commonly used in conjunction with firearms. When used in conjunction with stringed weapons (such as slings, slingshots, or trebuchets), bullets are also generally not fired in a manner where the string is under tension (taut). Instead, the inherent flexibility of the string is used to provide for the acceleration of the projectile through modification of angular momentum and mechanical advantage. Arrows and similar shafted projectiles, on the other hand, can be fired much more accurately at much lower speed than bullets as their inherent shape and size provides for improved flight characteristics.

Figure 1:
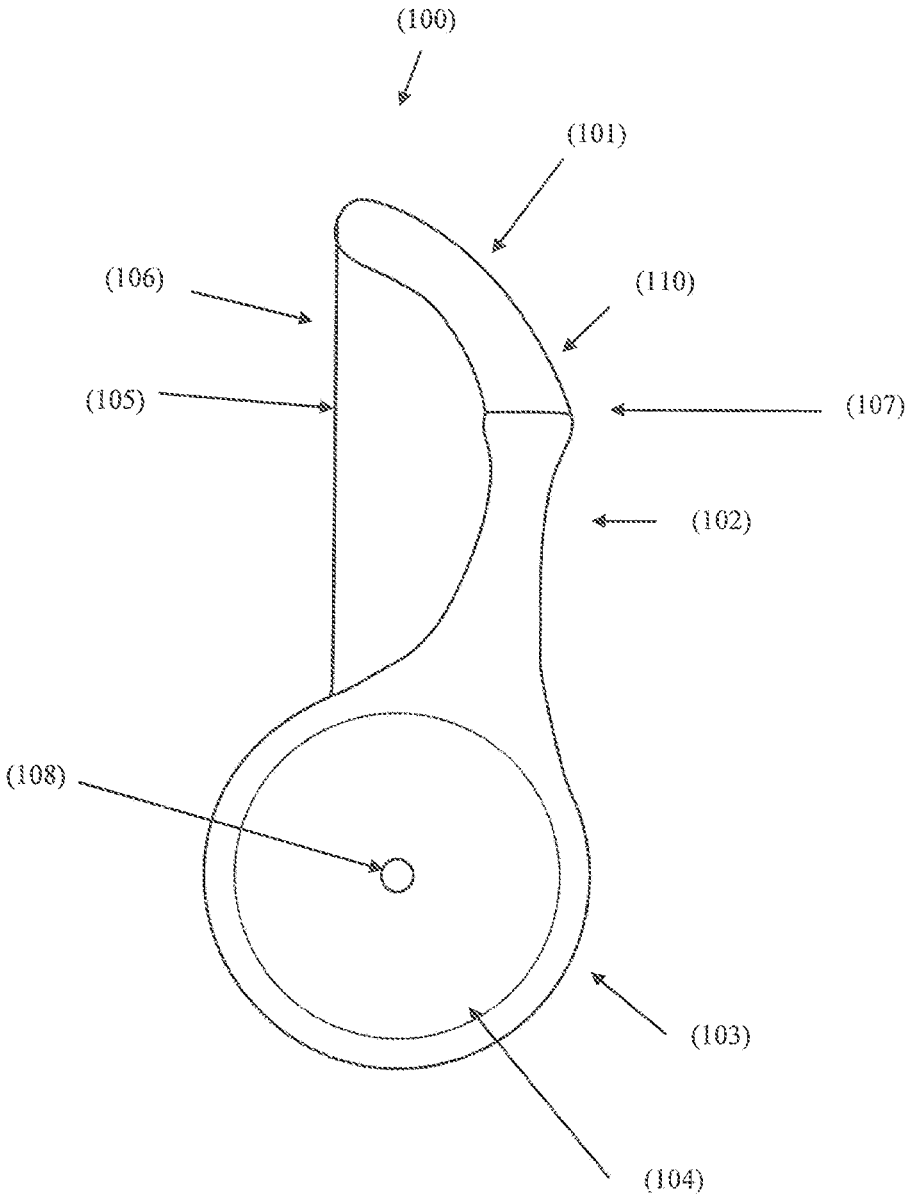
FIG. 1 provides a simplified side-view of an embodiment of a compact bow.

FIGS. 1 through 4 provide for an embodiment of a bow (100) according to the present disclosure. The bow (100) will generally comprise a body structure (110) of monolithic construction which may be made of any material and which is formed of three main sections. The uppermost section is a guide arm (101) which generally houses a hollow channel (206) through which the upper portion of the string (106) will pass. The guide arm (101) can also serve to move the fired (equilibrium) position of the string (106) (the point where the string (106) resides when no external force is placed on it as shown in FIG. 1) away from the grip (102) to allow for more comfortable nocking of the arrow and to avoid the string impacting a hand which is gripping the bow (100) when firing.

The grip (102) generally continues the channel (206) for the upper portion of the string (106) and serves as the position for the user to grip the bow (100) during drawing, firing and transport. The grip will often be contoured to fit a human hand but that is by no means required. There is generally an arrow rest (107) located at the top of the grip (102), between the grip (102) and the guide arm (101). However, inclusion of an arrow rest (107) is by no means necessary. The arrow rest (107) may be co-formed with the body (110) or may be attached to the body (110) in any manner known to one of ordinary skill in the art.

The bottom portion of the bow (100) comprises a generally circular-cylindrical spring housing (103) which is used to contain the spring mechanism of the bow (100). The housing (103) may include an access panel (104), which is removable for servicing or otherwise accessing the interior components of the housing (103) so as to access the spring (201) and spool (202) mechanisms and to allow for service and stringing of the bow (100).

Mounted on the housing (103), there may be an adjustment device (108) which can be used to alter the tension of the spring or springs (201) within the housing. In an embodiment, this may comprise a screw or worm drive which can be turned by hand or with a tool (such as, but not limited to a wrench) which serves to rotate the spring (201) within the housing. This can be used to increase or decrease the amount of tension on the spring (201) when the string (106) is in the equilibrium point (as shown in FIG. 1). Altering the starting torque on the spring (201) can be used to alter the amount of force required to draw the string (106) and, thus, the amount of force the string (106) can import to the arrow on firing.

Figure 2:
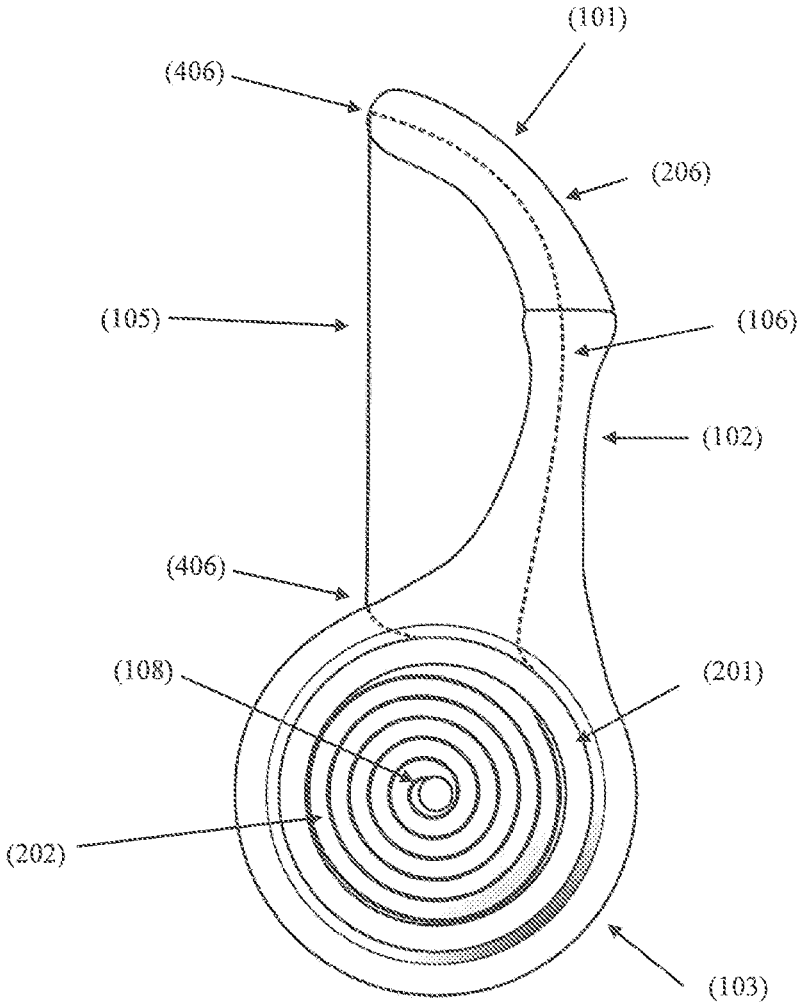
FIG. 2 provides a simplified side cutaway-view of the embodiment of FIG. 1 illustrating the position of a torsional coil spring and string channel within the spring housing.
Figure 3:
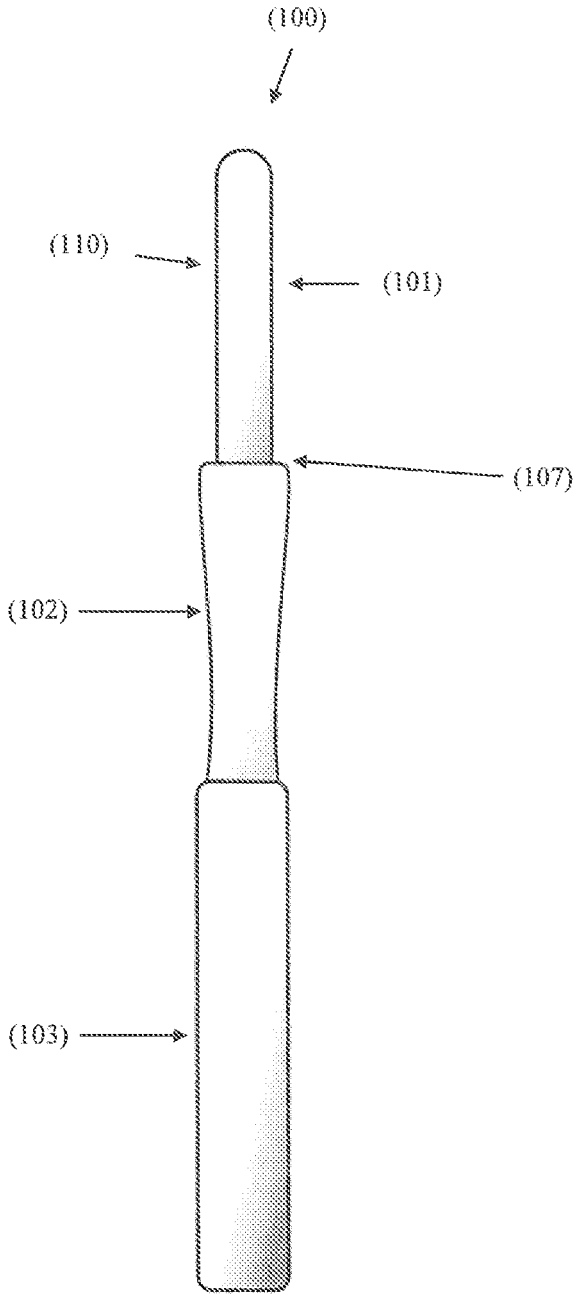
FIG. 3 provides a simplified front-view diagram of the embodiment of FIG. 1.

FIG. 2 shows a partial cut-away view of the device of FIG. 1. As can be seen in FIG. 2, the housing (103) will generally hold a string spool (202) and a torsion spring assembly (201). The torsion spring (201), in the depicted embodiment, comprises a flat coil spring although other forms of torsion spring including, but not limited to, a helical coil spring or a torsion bar spring, may be used in alternative embodiments. The spring (201) is generally attached to a the center adjustable axis (108) on one end and to the interior cavity of the spool (202) on the other end. The spring (201) may share a common axis with the spool (202).

Figure 4:
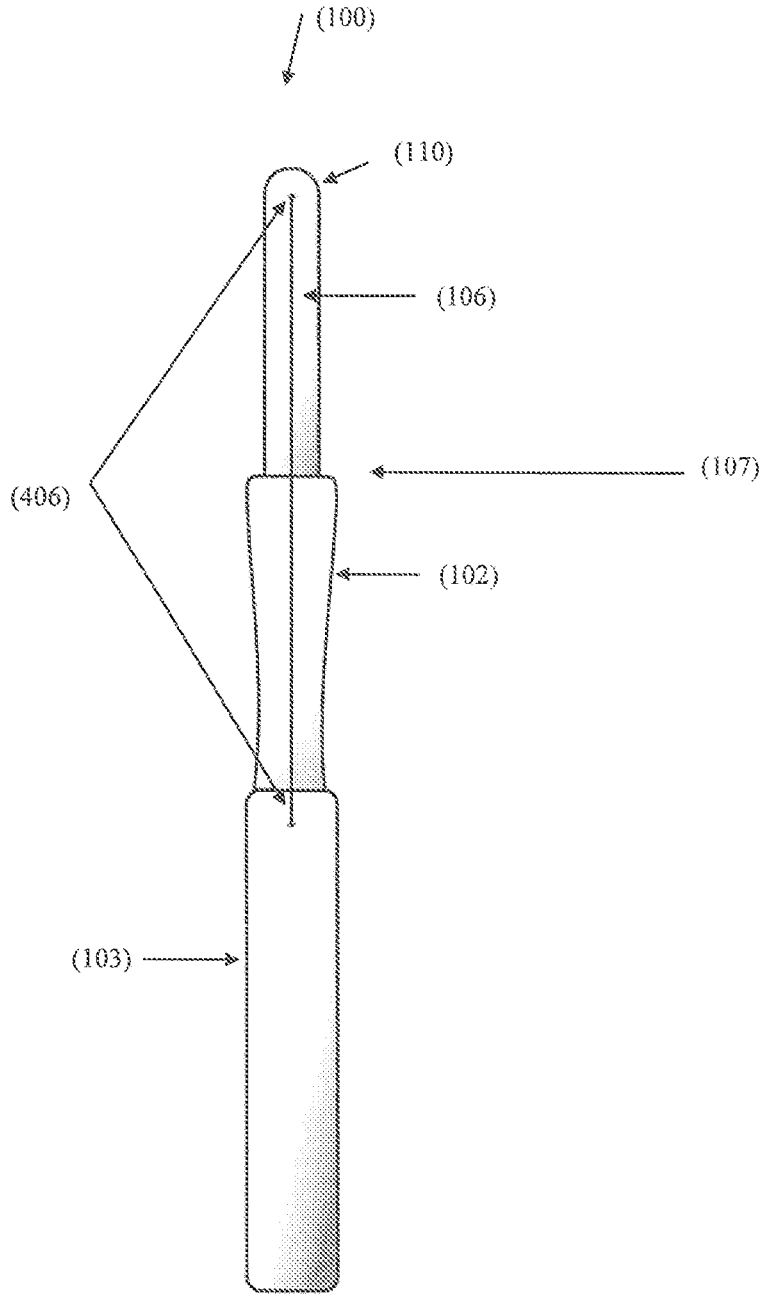
FIG. 4 provides a simplified rear-view diagram of the embodiment of FIG. 1.

As can also be seen in FIG. 2 and FIG. 4, the string (106) will generally extend between the guide arm (101) and housing (103) and will enter each of these components via a small portal (406). The portals (406) will generally be sized and shaped so as to approximate the diameter of the string (106) and will generally be arranged so that the string (106) will slide smoothly in a linear fashion through the portal (406) without damage or torque. The string (106) will generally be relatively inelastic (particularly when supplied with a longitudinal force) and may comprise any form of natural or synthetic fiber.

The string (106) will generally be connected at both ends to the spool (202) in such a fashion that when drawing the string (106) from the nock point (105) a generally equal amount of string (106) is provided to both portals (406) and the nock point (105) maintains the generally same distance from each of the portals (406) at all points in the drawing and firing. The string (106) will generally be under longitudinal tension due to the spring (201) pulling on both ends and the separation between the portals (406). To put this another way, the string (106) is generally held taut at all points during drawing and firing of the bow (100). Thus, the string (106) will generally be held taut in the position of FIG. 1 (which is often referred to herein as the equilibrium position) by the bow (100), unless a force is applied to the string (106) by an external actor.

Referring primarily to FIG. 1, in order to a fire an arrow, the user situates an arrow in the usual manner, affixing the nock at the end of the arrow to the nock point (105) on the string (106), and placing the shaft of the arrow on the arrow rest (107). They will place one hand on the hand grip (102) and with the other hand they will pull the string (106) at or near the nock point (105) away from the hand grip (left in FIG. 1). As the bow is so drawn, the string spool (202) will rotate letting out additional string (106) through both portals (406) in generally equal amounts. The rotation of the spool (202) as the string (106) unwinds from the spool (202) will in turn apply a torsional force to the torsion spring (201), thereby, winding the spring (201) tighter the more string (106) is pulled out of the portals (406).

Once sufficient string (106) has been pulled from the spool (202), the arrow will generally be positioned with its shaft generally within the space defined by the string (106) and body structure (110) with the arrowhead at or near the arrow rest (107). At this point the bow (100) is considered fully drawn and ready to fire. When the user releases the string (106) and arrow, the torsion spring (201) releases its potential energy and returns to its initial position. This spins the attached spool (202) in the opposing direction to the draw and rewinds the string (106) on the spool (202). The shortening of the string (106) thrusts the nock point (105) and arrow in a forward (rightward in FIG. 1) direction. As with drawing, the string will generally retract onto the spool (202) from both ends in equal amount. Thus, the nock point (105) will generally stay the same distance from each portal (406).

Once the string (106) reaches the equilibrium point of FIG. 1, the string (106) will generally be pulled taut between the portals (406) and will then cease forward (rightward in FIG. 1) motion as the string (106) outside the body structure (110) is now as short as allowed by the body structure (110) (at the equilibrium point). As the string (106) can no longer move forward, it will stop suddenly which will transfer a final amount of force to the arrow. The arrow will unnock from the string (106) and will continue forward over the arrow rest (107) and toward the target having been fired from the bow (100).

As indicated above in conjunction with the adjustment device (108), the user has the option to adjust the draw weight of the bow (100), generally by tightening or loosening the device (108) which can effectively apply a different amount of tension on the spring (201), and along the length of the string (106), when the string (106) is in the equilibrium position shown in FIG. 1. As a torsion spring (201) will generally have the amount of returning force it can apply increase the more it is torqued (pursuant to Moore's law), increasing the amount of torque on the spring (201) at the equilibrium point of FIG. 1 (prior to draw) through use of the device (108) will generally provide a higher draw strength and increase the power of the shot, while decreasing the amount of torque initially applied does the opposite.

Figure 5:
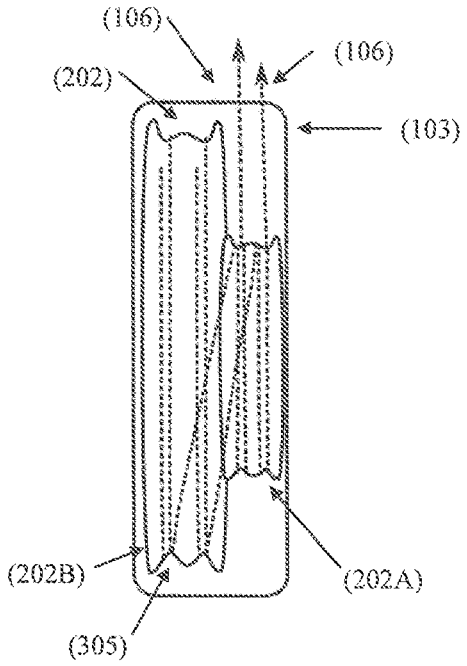
FIG. 5 provides an embodiment of the path of the bow string around a differential spool.
Figure 6:
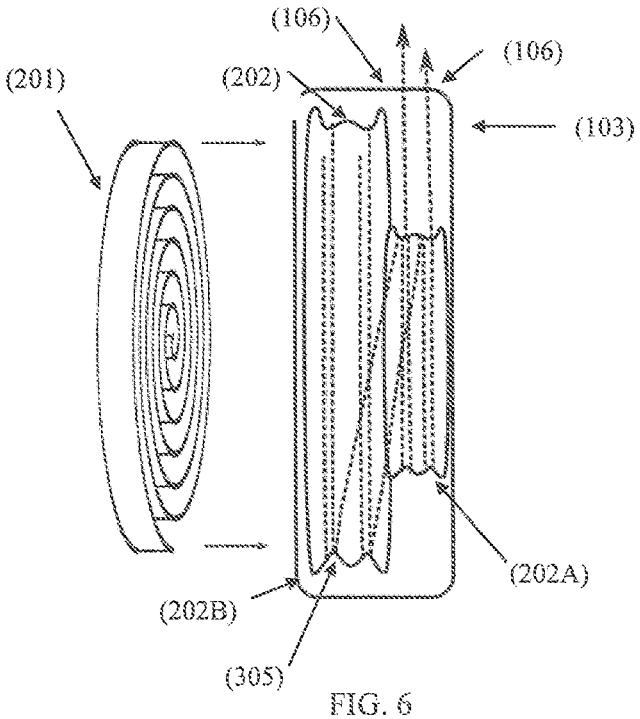
FIG. 6 provides an exploded view of a differential spool utilizing a single torsional coil spring.

In the embodiment of FIGS. 1-4, the bow (100) is shown including only a single diameter string spool (202) and a single torsional spring (201). While this can be effective in many embodiments, a single structure may not supply sufficient power to the arrow for some uses. FIG. 5 illustrates how the bow (101) may include a multi-dimensional string spool (202) having spools (202A) and (202B) of at least two different diameters. As can be seen in FIGS. 5 and 6, the string (106) can be directed to move between two different diameters of interconnected spools (202A) and (202B). This can allow for the draw force to be altered as perceived by the user pulling on the spring (201) through what is effectively a traditional gearing relationship. Specifically, toward the end of the draw cycle, the string (106) transfers from the smaller diameter spool (202A) to the surface of the spool (202B) with the larger circumference. This generally mirrors the force load cycle of a traditional compound bow making it easier to draw and hold the string (106) at this point.

It should be noted, that the string (106) can remain on the larger diameter spool (202B) during the firing, or can transfer between the spools (202B) and (202A) during firing depending on the embodiment. If the string (106) remains on the larger diameter spool (202B), this can dramatically increase the power of the bow (100) without significantly increasing the draw strength required as the string (106) is actually retracted much quicker than if the smaller spool (202A) was used. This embodiment, however, can present problems in the next draw action as the string (106) is rewound on a different spool section (202B) than is normally used for draw.

Figure 7:
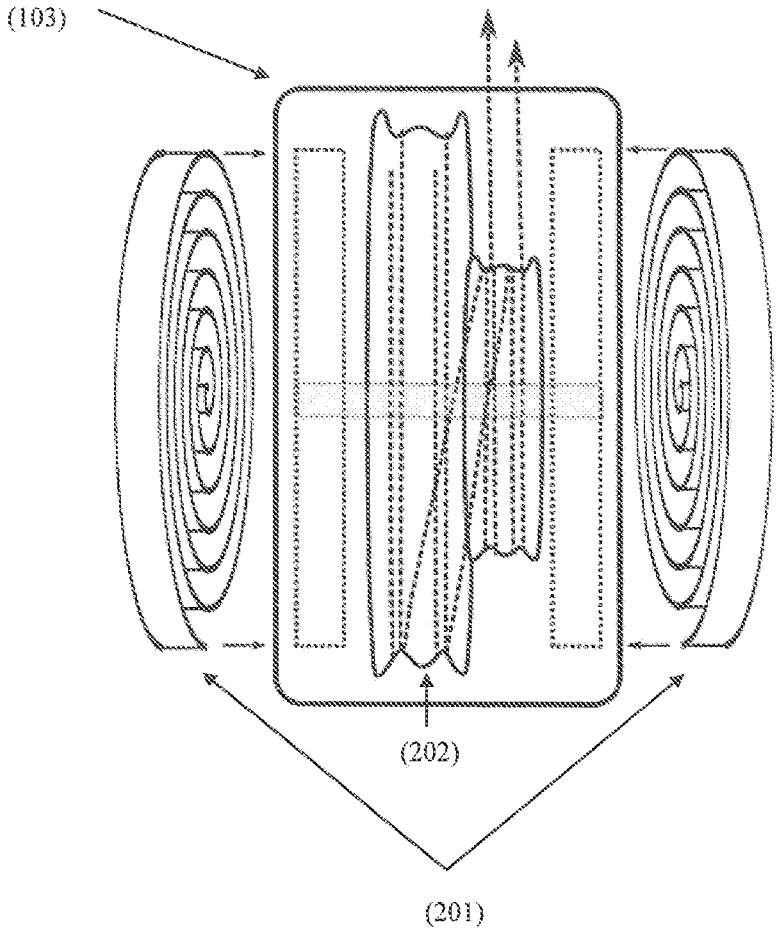
FIG. 7 provides an exploded view of a differential pulley utilizing multiple torsional coil springs.

FIG. 6 illustrates how the torsion spring (201) can be positioned using the multi-dimension spool of FIG. 5. The spring (201) may be beside the spool (202) and connected to the housing (103), or may be located within the center of one or more of the components (202A) and (202B). In order to increase draw strength, the embodiment of FIG. 7 may be used where there are two springs (201) instead of one. This arrangement can also serve to provide for better balance to the bow (100) as it allows for placement of springs (201) evenly from the center line of the bow (100), or a proportional distance based on their relative strength. Thus, the gyroscopic forces of the springs (201) are evenly distributed on both sides of the grip (102) which will generally inhibit the returning force from trying to pull the bow is one direction or the other, potentially spoiling the user's aim.

To inhibit the torsional force of the spring (201) from interfering with the aim of the bow (100), the spring (201) may be positioned in alignment with the intended trajectory of the arrow and may be placed below and to the rear of the device's grip. As both ends of the string enter the housing (101) and both attach to the same spool (202) and travel in the same direction of spin, the bow (100) allows an essentially identical pull on each end of the string (106), contributing to the accuracy of the draw and fire. Additionally, the spool (202) may have a spiral outer surface (305) and/or an internal track, to achieve a variable, compound force on the string during the draw and release cycle and to make sure that the string (106) follows a consistent path with each firing action.

The ends of the string will preferably enter the housing at equidistant points (406) from the nock (105) of the string (106). This provides equal tension and delivery of force to each end of the string (106) during draw and retracting relative to the nock point (105). As the centrifugal motion of the torsion spring (201) and spool (202) will create a gyroscopic effect which is generally below the user's hand, this can also serve to stabilize the bow (100) and minimize lateral drift (into and out of the page of FIG. 1) during the firing action.

Further, by having the spring (201) and spool (202) rotate clockwise in FIG. 1 during the release and firing of the arrow, the gyroscopic motion of the spool (202) will, if anything, serve to pull the aim downward. This can be a more natural motion for the shooter and will often not cause as much concern for the aim as the opposing option. Particularly, a downward pull may serve to pull the arrow rest (107) away from the arrow, but the motion of the bow (101) will generally not impart much position change to the arrow. Instead, the arrow's motion may already be dominated by its own flight characteristics even before it has fully cleared the bow (100). If the bow (100) was to pull upward, the arrow rest (107) could push the portion of the arrow shaft currently on the arrow rest (107) upward. This could interfere with the arrow's flight.

While the above provides for a number of different embodiments, it should be recognized that others could also be used. In an embodiment, instead of using a single spring (201) to pull both ends of the string (106), an individual spring (201) could be used for each end of the string (106). The springs (106) either could be collocated in housing (103) or with each located at an opposing side or end of the grip (102). This could allow for customized drawing and firing profiles, and could also serve to provide more power to the arrow without having to use more powerful springs (201). Still further, the bow (100) could utilize a ratcheting or locking mechanism whereby the user uses one spring (201) to draw the string (106) and a second which is connected to fire the arrow. Simply as an example, the user may actually draw the bow (100) multiple times to ratchet the spring (201) into position. They could then place the arrow and release the ratchet as a trigger.

It should also be noted that while the above contemplates the bow (100) being fired by a hand draw and hand release, this is by no means necessary and the bow (100) can be incorporated into another stringed weapon design. For example, the bow (100) could be used to replace the flat springs on a crossbow by being mounted horizontally or vertically on a stock and trigger assembly. Similarly, the arrow rest (107) could be replaced with a channel designed to carry a bullet or similar non-shafted projectile in the form of a stone-bow.

The bow (100) may be used for any purpose but is particularly suited for hunting or animal control situations where local terrain and flora may inhibit the use of a traditional bow due to its size. The bow (100) may be substantially lighter and more compact than traditional flat spring based weapons allowing it to be shot in areas where a large bow may become encumbered by branches, vegetation, or other barriers. In particular, as can be seen from FIG. 1, the bow (101) need not be much larger than the grip (102) which, in turn, can be based solely on the size of the users hand. In an embodiment, the entire device may only be 2-3 times larger than the user's fist making it easily transportable in a backpack or similar item. Further, the smaller configuration can also be particularly suited for situations where the user is encumbered with other supplies and equipment, such as is often the case with hunters or military personnel.

The bow (100) can also provide for improved safety through the inclusion of a number of additional safety features. In one, the bow (100) could be provided with an external lock, ratchet, or friction brake which can be used to stop or slow the retraction of the spool (202) when the bow (100) is drawn. In this way, should an arrow become unnocked during a draw, the user can engage the system and renock the arrow, or can engage or partially engage the system to allow the bow (100) to be dry-fired dissipating the force of the dry fire into the braking system to be safely dispersed as heat.

In a still further embodiment, safety can be further improved through design of the body structure (110). As opposed to a traditional bow, where the structure has to bend and flex to provide the firing force, the body structure (110) of bow (100) can be completely rigid with the only force being provided by the torsion spring (201). In the event of a catastrophic failure of the spring (201), the bow (100) will generally suffer a failure which can be contained within the spring housing (103) inhibiting flying parts from hitting the user or anyone nearby. Thus, the bow (100) will generally fail safer than a traditional bow where a damaged component can break and send parts of the bow flying in all directions, and particularly backward toward the user.

While the invention has been disclosed in connection with certain preferred embodiments, the elements, connections, and dimensions of the preferred embodiments should not be understood as limitations on all embodiments. Modifications and variations of the described embodiments may be made without departing from the spirit and scope of the invention, and other embodiments should be understood to be encompassed in the present disclosure as would be understood by those of ordinary skill in the art.

The invention claimed is:

1. A stringed weapon comprising:

a body structure;

a string having two ends and a nock point along a length therebetween;

a torsional spring located within said body structure; and a string spool located within said body structure, said spool including sections of at least two different circumferences;

wherein, both ends of said string are connected to said string spool and said string spool is functionally connected to said torsional spring so that drawing said nock point in a first direction serves to unwind said string from said spool in a first direction, said rotation of said spool in said first direction applying force to said spring so as to increase the potential energy of said spring; and wherein release of said string allows said spring to release said potential energy by rotating said spool in a second direction opposite said first, said release of potential energy rewinding said string on said spool and firing a projectile located at said nock point from said weapon.

2. The weapon of claim 1, wherein a larger circumference section of said spool is used to retract said string and a smaller circumference section of said spool is used to draw said string.

3. A stringed weapon comprising:

a body structure;

a string having two ends and a nock point along a length therebetween;

a torsional spring located within said body structure;

a string spool located within said body structure; and an adjustable axis which allows for modification of the torsion applied to said spring without drawing said string;

wherein, both ends of said string are connected to said string spool and said string spool is functionally connected to said torsional spring so that drawing said nock point in a first direction serves to unwind said string from said spool in a first direction, said rotation of said spool in said first direction applying force to said spring so as to increase the potential energy of said spring; and wherein release of said string allows said spring to release said potential energy by rotating said spool in a second direction opposite said first, said release of potential energy rewinding said string on said spool and firing a projectile located at said nock point from said weapon.

4. A stringed weapon comprising:

a body structure;

a string having two ends and a nock point along a length therebetween;

a torsional spring located within said body structure;

a string spool located within said body structure; and a second spring operatively connected to said spool;

wherein, both ends of said string are connected to said string spool and said string spool is functionally connected to said torsional spring so that drawing said nock point in a first direction serves to unwind said string from said spool in a first direction, said rotation of said spool in said first direction applying force to said spring so as to increase the potential energy of said spring; and wherein release of said string allows said spring to release said potential energy by rotating said spool in a second direction opposite said first, said release of potential energy rewinding said string on said spool and firing a projectile located at said nock point from said weapon.

* * * * *